US008726963B2

(12) United States Patent
Yeh

(10) Patent No.: US 8,726,963 B2
(45) Date of Patent: May 20, 2014

(54) ANTI-VIBRATING TAPE DISPENSER OF CARTON SEALING MACHINE

(76) Inventor: Yen-Cheng Yeh, Taichung (TW)

( * ) Notice: Subject to any disclaimer, the term of this patent is extended or adjusted under 35 U.S.C. 154(b) by 225 days.

(21) Appl. No.: 13/475,437

(22) Filed: May 18, 2012

(65) Prior Publication Data

US 2012/0298307 A1 Nov. 29, 2012

(30) Foreign Application Priority Data

May 24, 2011 (TW) ..... 100118054 A

(51) Int. Cl.
*B65H 75/44* (2006.01)
*B65B 51/06* (2006.01)

(52) U.S. Cl.
CPC ..... *B65H 75/4439* (2013.01); *B65H 75/4436* (2013.01); *B65H 75/4421* (2013.01); *B65B 51/067* (2013.01)
USPC ..... 156/538; 156/475; 156/476; 156/477.1; 156/478; 156/479; 156/480; 156/481; 156/486; 156/487; 156/488; 156/489; 156/490; 156/491; 156/510; 156/516; 156/517

(58) Field of Classification Search
CPC ..... B65H 75/4421; B65H 75/4436; B65H 75/4439; B65B 51/067
USPC ..... 156/475–481, 486–492, 510, 516, 517, 156/538
See application file for complete search history.

(56) References Cited

U.S. PATENT DOCUMENTS 3,765,992 A * 10/1973 Stageberg ..... 156/521
4,592,188 A * 6/1986 Marchetti ..... 53/136.4
4,789,418 A * 12/1988 Rayl ..... 156/468
5,286,332 A * 2/1994 Rossini ..... 156/510

* cited by examiner

*Primary Examiner* — Mark A Osele
*Assistant Examiner* — Christopher C Caillouet
(74) *Attorney, Agent, or Firm* — Muncy, Geissler, Olds & Lowe, P.C.

(57) ABSTRACT

An anti-vibrating tape dispenser of a carton sealing machine includes a stand erected on the carton sealing machine, a fixed shaft extended transversally from the stand, a sleeve provided for loading a tape and coaxially sheathed on the periphery of the fixed shaft, a slide mechanism installed on the stand and below the sleeve and including a slide rail slidably installed on a fixed rail, an abutting rod fixed onto the slide rail and extended in the same direction of the fixed shaft, an abutting roller sheathed on the abutting rod and abutted against the external periphery of the tape roller. As the external diameter of the tape roller varies, the abutting roller slides along the slide rail to abut against the external periphery of tape roller normally, and the abutting roller includes one-way bearings for limiting the abutting roller to rotate round the abutting rod in a direction only.

2 Claims, 9 Drawing Sheets

ANTI-VIBRATING TAPE DISPENSER OF CARTON SEALING MACHINE

BACKGROUND OF THE INVENTION

1. Field of the Invention

The present invention relates to a tape dispenser of a carton sealing machine, and more particularly to the tape dispenser capable of preventing bounces and vibrations produced during the process of cutting a tensioned tape, so as to achieve a smooth and steady supply of the tape.

2. Description of Related Art

In a conventional carton sealing machine, a tape is wound onto a sleeve and sheathed on a packaging base of the carton sealing machine, and pulled out and wound around several steering rods, so that the tape is situated at a flatly tension state to facilitate a carton sealing process. However, when the tensioned tape is cut after the carton is sealed, vibrations of the tape will be produced by a reaction force and fed back to the sleeve of the packaging base, so that the sleeve will be rotated in a direction opposite to the pulling direction of the tape to rewind the tape and produce wrinkles, and thus affecting the sealing quality adversely.

To overcome the aforementioned drawback, a design for preventing the sleeve from being rewound or producing wrinkles of the tape, the sleeve 7 is sheathed on a fixed shaft 71 and rotated by using the fixed shaft 71 as an axis, and a groove 72 is axially and concavely formed on a distal surface of the sleeve 7, and the groove 72 includes a bottom surface 721, and the fixed shaft 71 is protruded out from the bottom surface 721, and the portion of the fixed shaft 71 protruded out from the bottom surface 721 includes an outer thread 711, and the groove 72 includes a gasket 73, a spring 74 and a knob 75 sequentially installed along the fixed shaft 71 therein, and the knob 75 is rotated downwardly along the outer thread 711 of the fixed shaft 71 to compress the spring 74 and further compress the gasket 73, so that the gasket 73 is abutted tightly against the bottom surface 721 of the groove 72 to produce a frictional resistance, and a rotating displacement of the sleeve 7 with respect to the gasket 73 cannot be produced easily. As a result, the sleeve 7 will not be rewound to avoid a wrinkled tape produced at the moment of cutting the tape and producing a reaction force fed back to the sleeve 7 of the packaging base during the carton sealing process, However, this design makes use of the elasticity of the spring 74 to adjust the force of abutting the gasket 73 against the bottom surface 721 of the groove 72 in order to produce a frictional resistance by rotating the sleeve 7 around the fixed shaft 71. if the spring 74 is elastically fatigue, then a sufficient compressing force will not be provided, or the frictional resistance is insufficient to resist the rewinding force of the sleeve caused by the vibration of the tape, thus affecting the sealing quality again. In addition, this design involves complicated components and inconvenient production, assembling, and repair and maintenance processes and obviously requires improvements.

SUMMARY OF THE INVENTION

In view of the aforementioned problems, it is a primary objective of the present invention to provide an anti-vibrating tape dispenser of a carton sealing machine and improves over the conventional design by installing one-way bearings in an abutting mechanism to prevent rewinding of the sleeve caused by the feedback vibrations of the tape, instead of using the conventional design with a spring of a sleeve of the tape dispenser of the carton sealing machine.

To achieve the aforementioned objective, the present invention provides an anti-vibrating tape dispenser of a carton sealing machine, comprising:

a stand, erected on the carton sealing machine, and including a fixed shaft installed thereon and extended transversally from the stand, and a sleeve provided for loading a tape and coaxially sheathed on an outer side of the periphery of the fixed shaft, and being rotatable around the fixed shaft;

a slide mechanism, including a fixed rail and a slide rail, and the fixed rail being fixed to the stand and situated below the sleeve, and the slide rail being installed on the fixed rail by clamping a ball bearing device, and slidable along the fixed rail;

an abutting mechanism, including an abutting rod and an abutting roller, wherein the abutting rod is fixed onto the slide rail and extended in the same direction of the fixed shaft, and the abutting roller includes an axially penetrating shaft hole sheathed on the abutting rod and rotatable around the abutting rod, and an external periphery of the abutting roller is abutted against the periphery of a tape roller and mounted onto the sleeve and as the external diameter of the tape roller varies, the abutting roller slides along the slide rail to abut against the external periphery of tape roller normally, and the abutting roller includes a plurality of one-way bearings installed on a sidewall ring of the shaft hole, such that the abutting roller can be rotated round the abutting rod in a direction only.

DETAILED DESCRIPTION OF THE PREFERRED EMBODIMENTS

Figure 1:
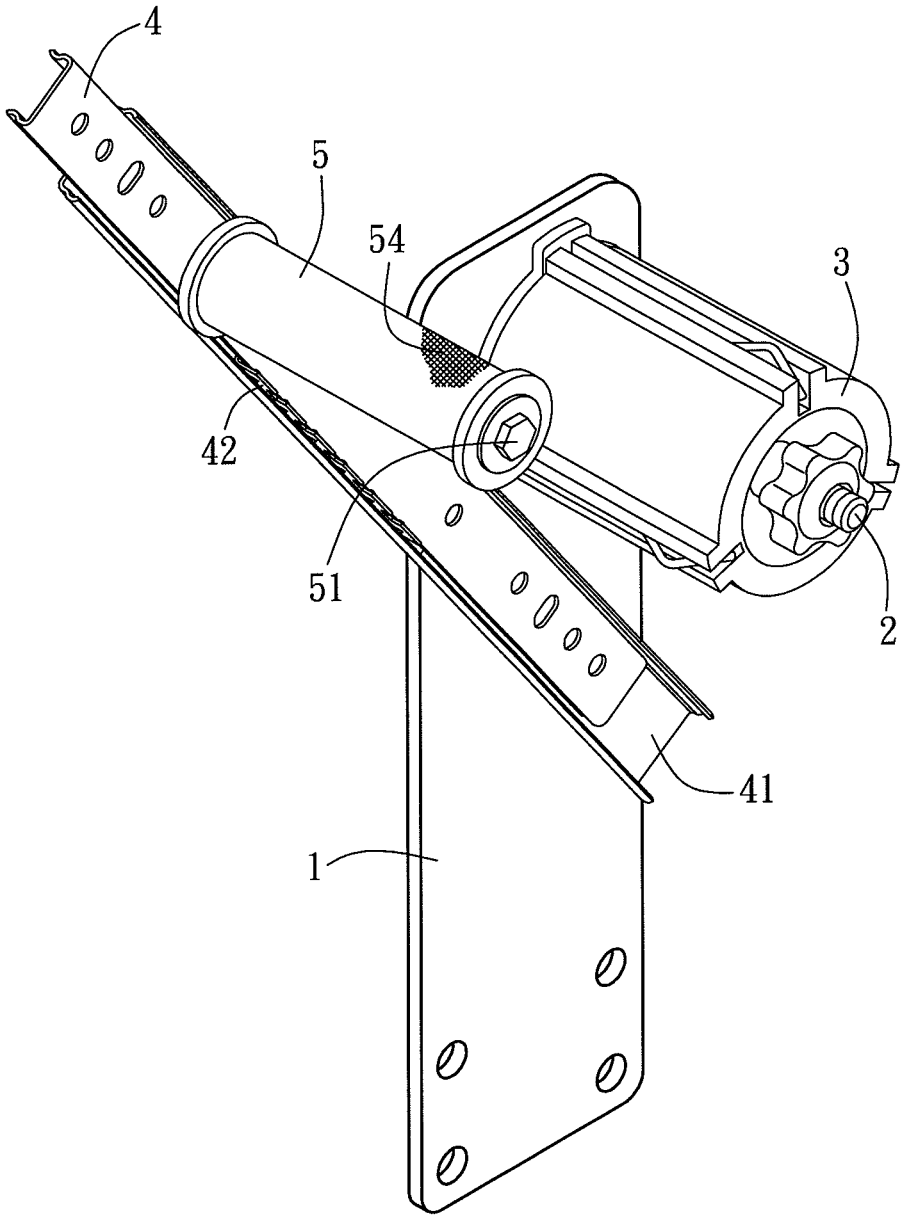
FIG. 1 is a perspective view of the present invention.
Figure 2:
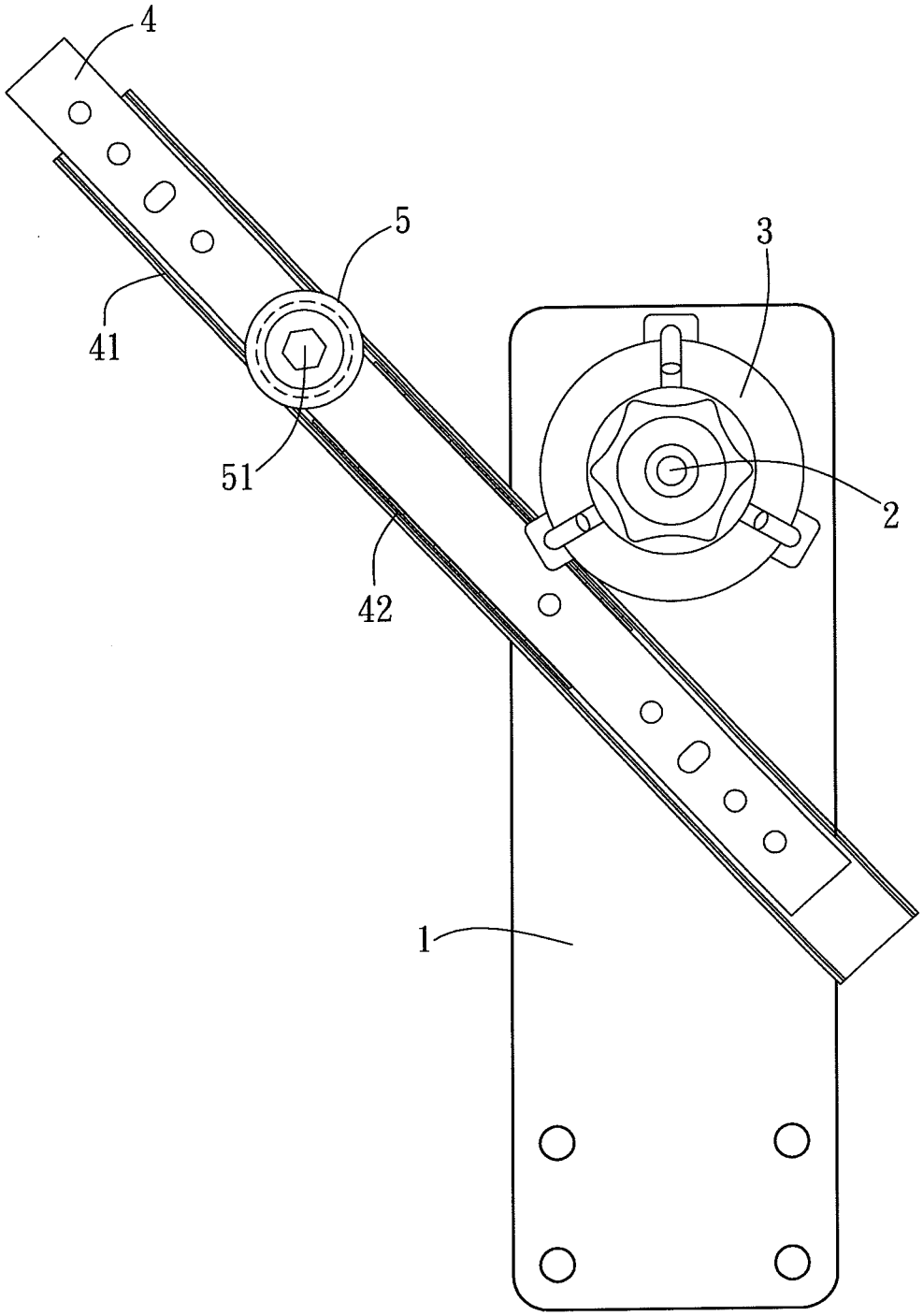
FIG. 2 is a side view of the present invention.

With reference to FIGS. 1 and 2 for an anti-vibrating tape dispenser of a carton sealing machine of the present invention, the anti-vibrating tape dispenser of a carton sealing machine comprises:

a stand 1, erected on a side of the carton sealing machine, including a fixed shaft 2 installed thereon and extended transversally from the stand 1, a sleeve 3 provided for loading a tape and coaxially sheathed on an outer side of the periphery of the fixed shaft 2, and being rotatable around the fixed shaft 2;

a slide mechanism, including a fixed rail 41 and a slide rail 4, wherein the fixed rail 41 is fixed to the stand 1 and situated below the sleeve 3, and the slide rail 4 is installed on the fixed rail 41 by clamping a ball bearing device 42, and slidable along the fixed rail 41, and the ball bearing device 42 rolls between the fixed rail 41 and the slide rail 4, such that the slide rail 4 can slide along the fixed rail 41;

an abutting mechanism, including an abutting rod 51 and an abutting roller 5, wherein the abutting rod 51 is fixed on the slide rail 4 and extended in the same direction of the fixed shaft 2, and the abutting roller 5 includes an axially penetrating shaft hole 52, and the shaft hole 52 of the abutting roller 5 is sheathed on the abutting rod 51 and rotatable around the abutting rod 51, and when the slide rail 4 moves along the fixed rail 41, the abutting roller 5 will displace accordingly.

Figure 3:
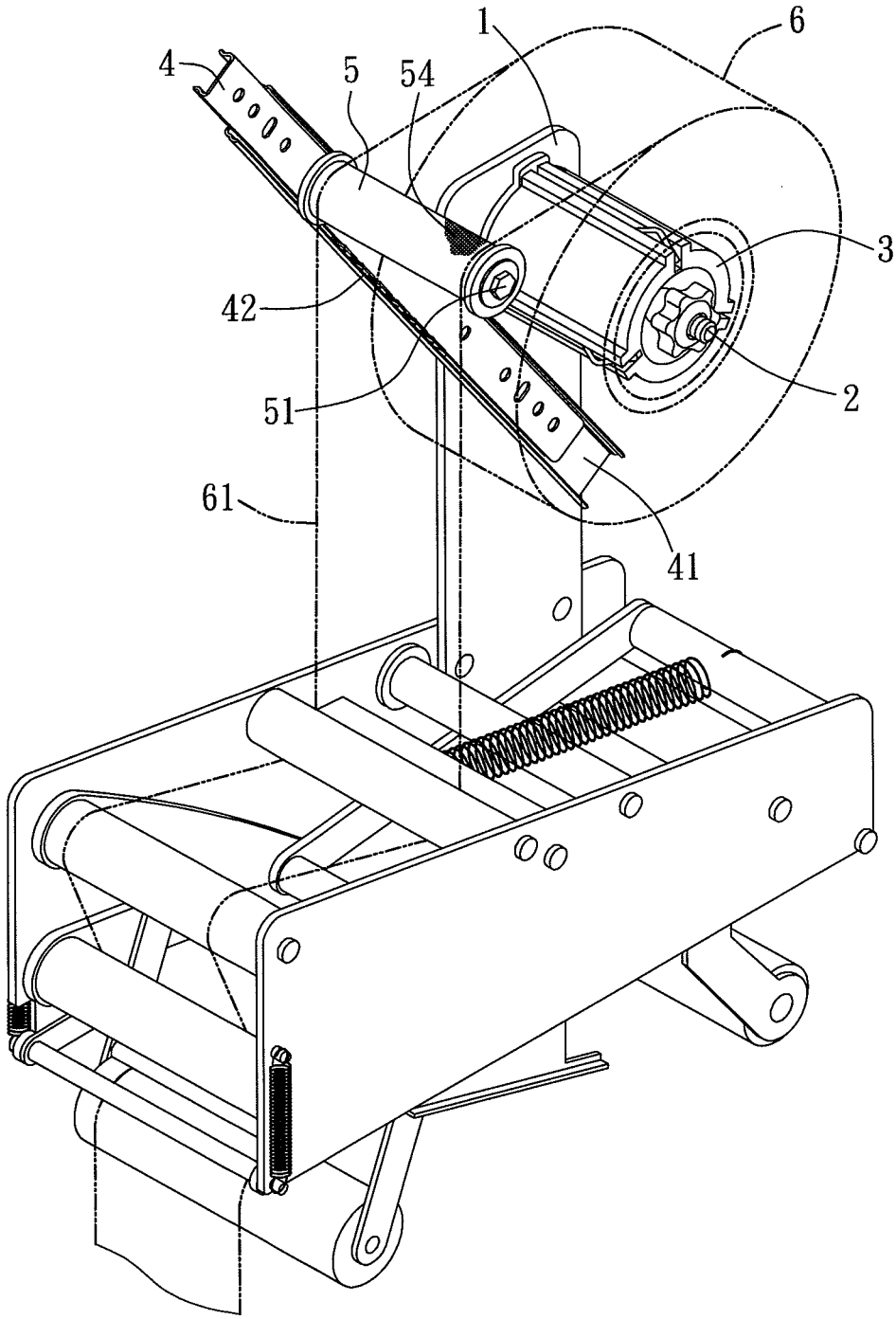
FIG. 3 is a schematic view of an application of the present invention.
Figure 4:
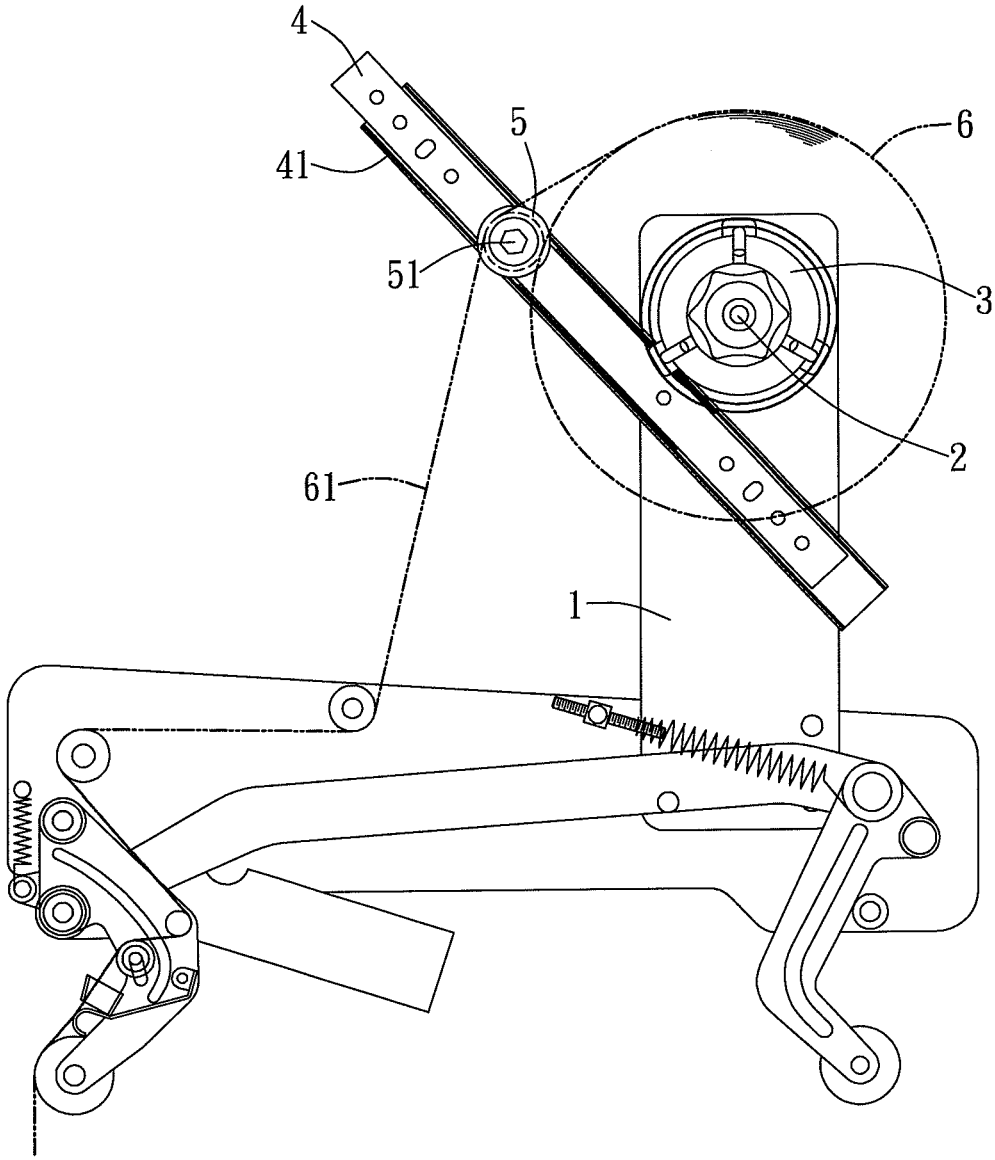
FIGS. 4, 5 and 6 are schematic views of using states of the present invention.
Figure 5:
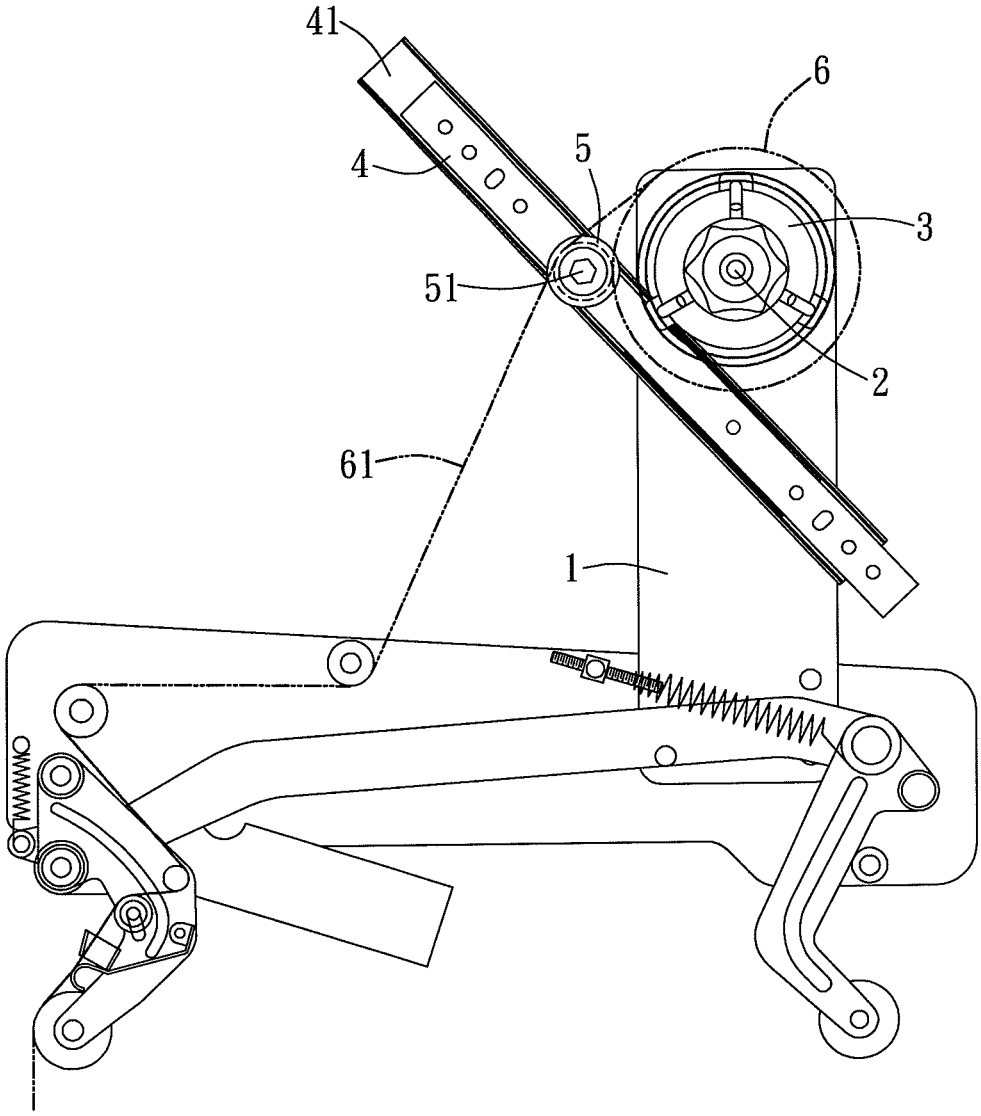

In a practical application of the present invention as shown in FIG. 3, the tape roller 6 is axially sheathed on the sleeve 3 of the stand 1, and then a tape 61 is pulled out and wound around the abutting roller 5 and then wound around a steering rod of the carton sealing machine, such that the tape 61 is situated at a tension state to facilitate the carton sealing process. In FIGS. 4 and 5, the external periphery of the abutting roller 5 is abutted against the periphery of the tape roller 6, and the gravitational force of the abutting roller 5 is pressed downwardly at the tape roller 6. During the process of using the carton sealing machine, the external diameter of the tape roller 6 is getting smaller and smaller. Due to the gravitational force, the abutting roller 5 drives the slide rail 4 to slide downwardly along the fixed rail 41 and continues to abut against the periphery of the tape roller 6 and always maintains the tape 61 at the tension state to assure the sealing quality.

Figure 6:
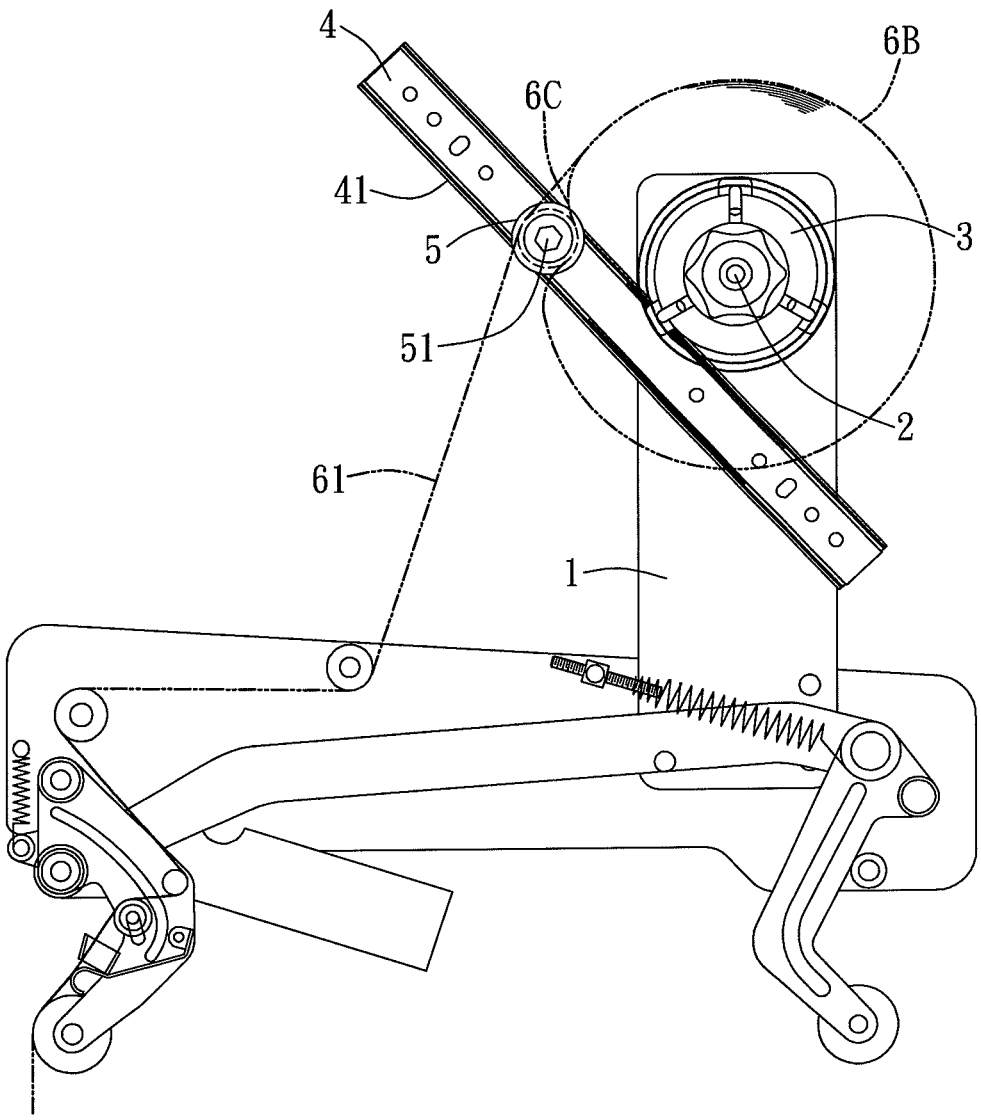

If the quality of the tape roller 6B is low, the tape roller 6B is not in a circular shape, or the tape roller 6B has an irregular concave or convex shape as shown in FIG. 6, the abutting roller 5 always abuts the external periphery of the tape roller 6B by the gravitational force of the abutting roller 5. When the abutting roller 5 sinks into a recess 6C of the tape roller 6B, the slide rail 4 drives the abutting roller 5 to displace downward to abut against the recess 6C of the tape roller 6B, so that the pulled-out tape 61 can always maintains its tension state to assure the sealing quality.

Figure 7:
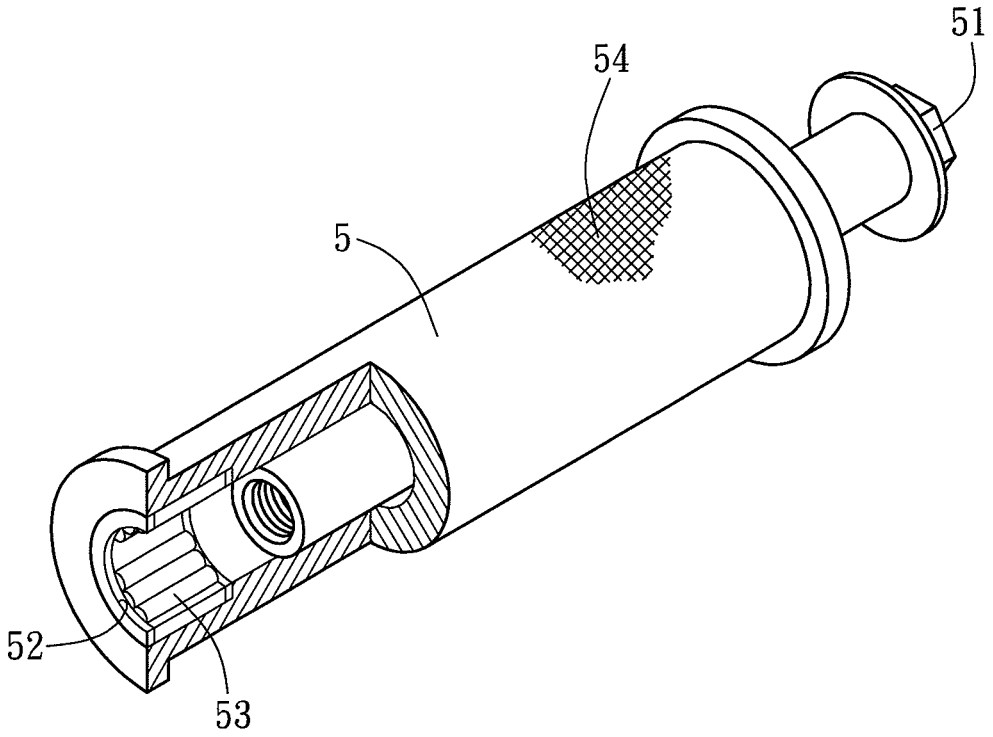
FIG. 7 is a cross-sectional view of an abutting mechanism of the present invention.
Figure 8:
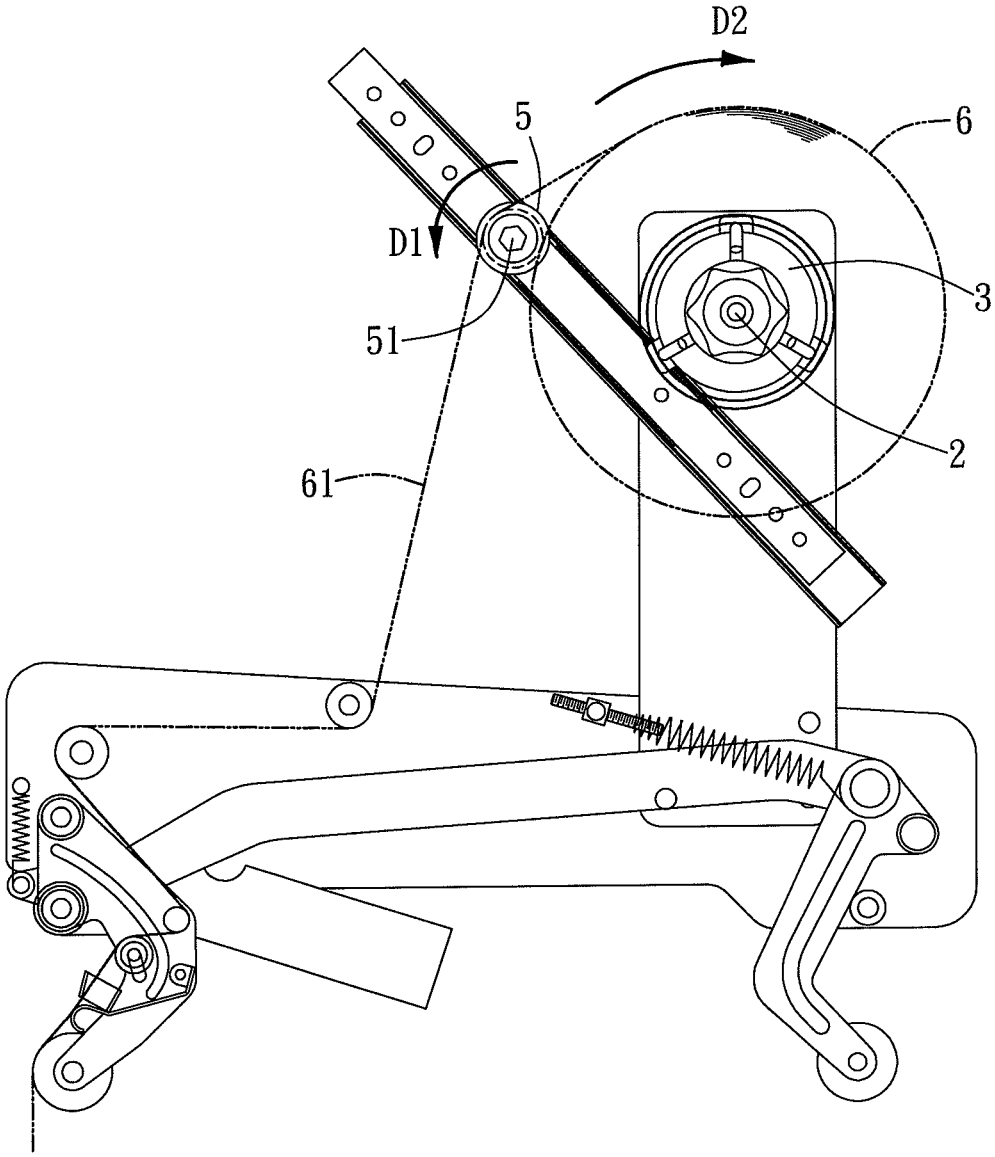
FIG. 8 is a schematic view of an application of the present invention, indicating the status that a sleeve will not be rewound.
Figure 9:
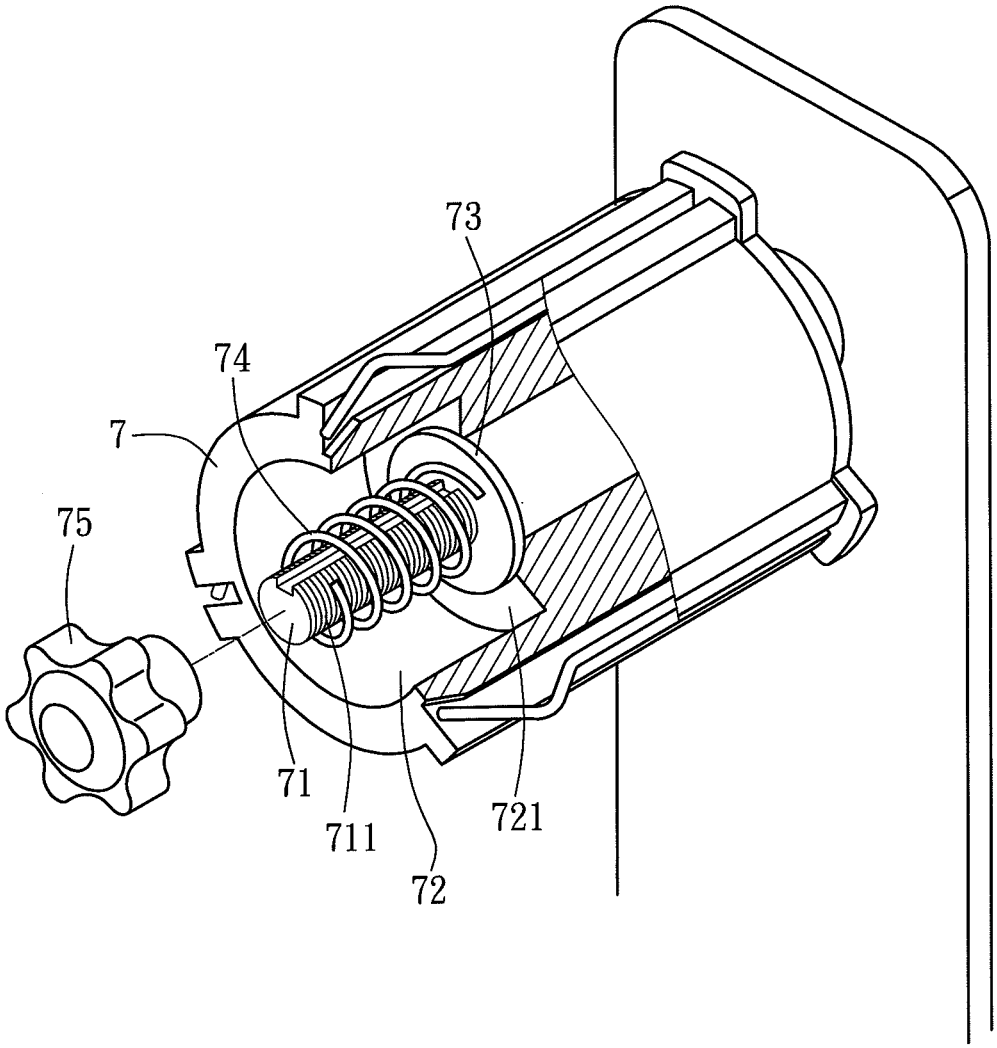
FIG. 9 PRIOR ART
FIG. 9 is a cross-sectional view of a sleeve of a conventional carton sealing machine.

In FIGS. 7 and 8, the abutting roller 5 includes a plurality of one-way bearings 53 installed along the sidewall ring of the shaft hole 52, such that the abutting roller 5 can be rotated around the abutting rod 51 in the same direction of pulling out the tape 61 only. Since the tape 61 pulled out from the tape roller 6 is always maintained at the tension state, and an outward pulling force is formed on the tape roller 6 and in the direction D1 of pulling out the tape 61, and the pulling force also forms a reaction force on the tape roller 6, such that after the carton sealing process is completed, and the tape 61 is being cut, the pulling force of the tape 61 diminishes immediately, and the reaction force also diminishes at the same time. As a result, the inertia produced by the reaction force drives the tape roller 6 to rotate in a direction D2 opposite to the direction of pulling out the tape 61, and tend to rewind tape 61. However, there is a one-way bearing 53 in the abutting roller 5 to restrict the abutting roller 5 to rotate around the abutting rod 51 in the same direction D1 of pulling out the tape 61 only. Further, the contact surface of the tape 61 and the abutting roller 5 has an anti-slide pattern 54, and thus a relative displacement between tape 61 and the abutting roller 5 will not occur, and the inertia for rewinding the tape roller 6 is overcome by the one-way bearing 53 of the abutting roller 5. As a result, the rewind of the tape roller 6 will not occur, and the invention can prevent the wrinkled tape caused by the rewind of tape roller 6 and the rewind of the tape.

In summation of the description above, the present invention makes use of the gravitational force of the abutting roller 5 and the slide of the slide rail 4 on the fixed rail 41 to abut the external periphery of the tape roller 6 normally, and maintain the tape 61 at a tension state. In addition, the one-way bearing 53 is installed in the shaft hole 52 of the abutting roller 5 and provided for restricting the abutting roller 5 to rotate in the same direction D1 of pulling out the tape 61 only. The invention replaces the conventional rewinding prevention mechanism of the sleeve of the packaging base of the carton sealing machine that uses a compression spring to produce a rotational resistance of the sleeve, and the invention also achieves the effects of simplifying the complicated components, production and assembling processes, and reducing the maintenance and repair time and cost.

What is claimed is:

1. An anti-vibrating tape dispenser of a carton sealing machine, comprising a stand, a slide mechanism and an abutting mechanism, characterized in that:

the stand is erected on the carton sealing machine, and the stand includes a fixed shaft installed thereon and extended transversally from the stand, and a sleeve provided for loading a tape and coaxially sheathed on an outer side of the periphery of the fixed shaft, and being rotatable around the fixed shaft;

the slide mechanism includes a fixed rail and a slide rail, and the fixed rail is fixed to the stand and situated below the sleeve, and the slide rail is installed on the fixed rail by clamping a ball bearing device, and slidable along the fixed rail;

the abutting mechanism includes an abutting rod and an abutting roller, and the abutting rod is fixed onto the slide rail and extended in the same direction of the fixed shaft, and the abutting roller includes an axially penetrating shaft hole sheathed on the abutting rod and rotatable around the abutting rod, and an external periphery of the abutting roller is abutted against the periphery of a tape roller and mounted onto the sleeve and as the external diameter of the tape roller varies, the abutting roller slides along the slide rail to abut against the external periphery of tape roller normally, and the abutting roller includes a plurality of one-way bearings installed on a sidewall ring of the shaft hole, such that the abutting roller can be rotated round the abutting rod in a direction only.

2. The anti-vibrating tape dispenser of a carton sealing machine as recited in claim 1, wherein the abutting roller further includes an anti-slide pattern formed on the external periphery of the abutting roller for preventing the tape from sliding on the abutting roller.

* * * * *